US009045909B1

(12) United States Patent
Preuss

(10) Patent No.: US 9,045,909 B1
(45) Date of Patent: Jun. 2, 2015

(54) SYSTEMS AND METHODS FOR WIDE ENGINEERED SIDING

(71) Applicant: Gunter Preuss, Loveland, CO (US)

(72) Inventor: Gunter Preuss, Loveland, CO (US)

(73) Assignee: Gunter Preuss, Loveland, CO (US)

( * ) Notice: Subject to any disclaimer, the term of this patent is extended or adjusted under 35 U.S.C. 154(b) by 0 days.

(21) Appl. No.: 13/648,943

(22) Filed: Oct. 10, 2012

Related U.S. Application Data

(60) Provisional application No. 61/545,985, filed on Oct. 11, 2011.

(51) Int. Cl.
*E04B 2/00* (2006.01)
*E04F 13/08* (2006.01)

(52) U.S. Cl.
CPC ..... *E04F 13/0864* (2013.01)

(58) Field of Classification Search
CPC ..... E04F 13/0864; E04F 13/147
USPC ..... 52/279, 280, 281, 287.1, 288.1, 309.15, 52/314, 555, 591.4
See application file for complete search history.

(56) References Cited

U.S. PATENT DOCUMENTS

| | | | | |
|---|---|---|---|---|
| 1,996,735 | A | | 4/1935 | King |
| 3,289,380 | A | * | 12/1966 | Charniga, Jr. ..... 52/717.06 |
| 4,012,876 | A | | 3/1977 | Grubbs |
| 4,277,925 | A | * | 7/1981 | Kinser ..... 52/233 |
| 4,320,610 | A | | 3/1982 | Rupp |
| 4,569,873 | A | | 2/1986 | Robbins |
| 4,627,204 | A | | 12/1986 | Smith |
| 4,840,003 | A | | 6/1989 | Lucas et al. |
| 4,844,763 | A | | 7/1989 | Robbins |
| 4,864,787 | A | | 9/1989 | Bukowski |
| 4,878,328 | A | | 11/1989 | Berge |
| 4,918,888 | A | | 4/1990 | Giles et al. |
| 5,010,701 | A | | 4/1991 | Halsey et al. |
| 5,029,425 | A | | 7/1991 | Bogataj |
| 5,167,103 | A | | 12/1992 | Lindal |
| 5,293,728 | A | | 3/1994 | Christopher et al. |
| 5,363,621 | A | | 11/1994 | Kroll et al. |
| 5,448,865 | A | | 9/1995 | Palmersten |
| 5,502,939 | A | | 4/1996 | Zadok et al. |
| 5,522,193 | A | | 6/1996 | Sommerstein et al. |
| 5,577,357 | A | | 11/1996 | Civelli |
| 5,638,649 | A | | 6/1997 | Hovland |
| 6,000,177 | A | | 12/1999 | Davidson |
| D419,246 | S | | 1/2000 | Lane et al. |

(Continued)

FOREIGN PATENT DOCUMENTS

| | | | |
|---|---|---|---|
| WO | 02070341 | A2 | 9/2002 |
| WO | 2009007103 | A2 | 1/2009 |

OTHER PUBLICATIONS

U.S. Appl. No. 61/545,985, filed Oct. 11, 2011, Entitled: Wide Engineered Siding Systems and Methods.

(Continued)

*Primary Examiner* — Jeanette E Chapman
*Assistant Examiner* — James Buckle, Jr.
(74) *Attorney, Agent, or Firm* — Santangelo Law Offices, P.C.

(57) ABSTRACT

An aesthetically pleasing endless cornered wood siding resembling solid wood paneling system providing, in some embodiments, a continuous flow of wood grain from one side of a panel, around a corner, to an other side of the paneling which may include an internal chamber system perhaps having spaced internal core elements or the like.

6 Claims, 10 Drawing Sheets

(56) References Cited

U.S. PATENT DOCUMENTS

| | | | | |
|---|---|---|---|---|
| 6,189,271 | B1 | 2/2001 | Christensen | |
| D449,121 | S | 10/2001 | Hunter et al. | |
| 6,314,701 | B1 | 11/2001 | Meyerson | |
| 6,427,414 | B1 * | 8/2002 | Wing | 52/590.1 |
| 6,684,587 | B2 | 2/2004 | Shaw et al. | |
| D519,651 | S | 4/2006 | Simic | |
| 7,043,884 | B2 | 5/2006 | Moreno | |
| 7,188,456 | B2 | 3/2007 | Knauseder | |
| D576,315 | S | 9/2008 | Mock et al. | |
| 7,877,943 | B2 * | 2/2011 | Hikai | 52/288.1 |
| 7,966,783 | B2 | 6/2011 | Wilson et al. | |
| 8,136,316 | B2 * | 3/2012 | Schwarz et al. | 52/288.1 |
| 8,141,308 | B2 * | 3/2012 | Cashman | 52/287.1 |
| D670,824 | S | 11/2012 | Preuss | |
| 8,302,355 | B2 * | 11/2012 | Cook et al. | 52/233 |
| D681,236 | S | 4/2013 | Preuss | |
| 2002/0050114 | A1 | 5/2002 | Friso | |
| 2002/0121064 | A1 | 9/2002 | Erwin | |
| 2003/0037504 | A1 | 2/2003 | Schwitte et al. | |
| 2003/0041545 | A1 | 3/2003 | Stanchfield | |
| 2003/0145550 | A1 | 8/2003 | Bennett et al. | |
| 2003/0159380 | A1 * | 8/2003 | Doucet et al. | 52/287.1 |
| 2004/0031226 | A1 | 2/2004 | Miller et al. | |
| 2004/0187412 | A1 | 9/2004 | McCain | |
| 2006/0032167 | A1 | 2/2006 | Cecilio et al. | |
| 2006/0096217 | A1 | 5/2006 | Lance et al. | |
| 2007/0204538 | A1 | 9/2007 | Miller et al. | |
| 2007/0245652 | A1 | 10/2007 | Lechasseur | |
| 2008/0127583 | A1 | 6/2008 | Wrightman et al. | |
| 2008/0295439 | A1 | 12/2008 | Janesky | |
| 2009/0199497 | A1 | 8/2009 | Wrightman | |
| 2009/0293373 | A1 | 12/2009 | Klinkhamer et al. | |
| 2009/0293407 | A1 | 12/2009 | Swanson | |
| 2010/0011690 | A1 * | 1/2010 | Schwarz et al. | 52/314 |
| 2010/0242387 | A1 * | 9/2010 | Cashman | 52/287.1 |
| 2012/0151850 | A1 * | 6/2012 | Cashman | 52/36.3 |
| 2013/0008107 | A1 | 1/2013 | Herman | |

OTHER PUBLICATIONS

U.S. Appl. No. 13/632,909, filed Oct. 1, 212, Entitled: Composite Siding With Improved Interlaced End-Grain Corner Configuration and False Chinking Joint.

U.S. Appl. No. 29/403,824, filed Oct. 11, 2011; notice of allowance dated Dec. 12, 2012.

U.S. Appl. No. 29/403,113, filed Sep. 30, 2011; notice of allowance dated Sep. 12, 2012.

US Office Action dated Dec. 26, 2013 in U.S. Appl. No. 13/632,909.

U.S. Appl. No. 13/632,909, filed Oct. 1, 2012, Office Action dated Sep. 8, 2014.

* cited by examiner

SYSTEMS AND METHODS FOR WIDE ENGINEERED SIDING

This is a U.S. Non-Provisional patent application claiming the benefit of and priority to U.S. Provisional Application No. 61/545,985 filed Oct. 11, 2011, hereby incorporated by reference herein in its entirety.

FIELD OF THE INVENTION

The present invention generally relates to the field of building construction. Specifically, the present invention relates to a composite siding with wide interlocking panels that may provide the appearance of solid panels perhaps even solid wood panel siding. The present invention may provide siding that has an internal chamber system which may provide durability of the siding while maintaining an aesthetic and realistic appearance of a solid panel siding.

BACKGROUND OF THE INVENTION

It is well-known to construct a building with traditional siding used as an outer covering or cladding to protect the building from the effects of weather and perhaps even to provide insulation to the building. On a building that uses siding, the siding may act as part of the aesthetic beauty of the structure. Many different types of siding systems have been used in the past and may include panels, boards, and shingles. It may be important to consider the kind of attachment system used when connecting siding panels so as to avoid wind and rain infiltration through the joints. This may be resolved by overlapping, by covering or sealing the joint, or even by creating an interlocking joint such as a tongue and groove. Since building materials expand and contract with changing temperature and humidity, it may not be practical to make rigid joints between siding elements and it may not be practical to provide wide solid wood siding elements as they may crack and deteriorate over time.

Generally, wood panels may include a composite wood and veneer component as discussed in US Patent Application Publication No. US2006/0032167A1 to Cecilio et al., hereby incorporated by reference herein. Interlockable panels have been used in the past such as discussed in US Patent Application Publication No. US2003/0041545A1 to Stanchfield et al., hereby incorporated by reference herein. Further, panel mounting arrangement systems as discussed in U.S. Pat. No. 5,522,193 to Sommerstein et al., hereby incorporated by reference herein, provides a panel attachment system using support pins adapted to be inserted along slots within panels.

The present invention, in its various embodiments, recognizes and addresses these and other problems by providing wide siding systems and methods with interlocking and even durable panels, perhaps even having an appearance of wide solid wood paneling such as in resolving the issue of cracking and weathering of past solid wood paneling.

SUMMARY OF THE INVENTION

The present invention discloses methods and systems for providing durable, wide, interlocking, and even aesthetically gorgeous siding for use over conventional or prefabricated walls or building frames.

It is therefore broadly an object of the present invention to provide improved methods and apparatus for siding over a building structure.

Another object of the present invention may include, in embodiments, the appearance of wide panel siding used on the exteriors of building structures or the like.

Yet another object of the present invention may include, in embodiments, an engineered panel siding structure having an internal chamber system.

Another object of the present invention may include providing an interlocking system between siding panels and may even include a tongue and groove attachment between panels.

It is yet another object of the present invention to provide a composite siding system that has a gap between the siding panels once attached.

Naturally, further objects, goals and embodiments of the invention are disclosed throughout other areas of the specification, claims, and figures.

BRIEF DESCRIPTION OF THE DRAWINGS

The following descriptions and referenced drawings are for selected embodiments of the present invention. Naturally, changes may be made to the disclosed embodiments while still falling within the scope and spirit of the present invention and the patent granted to its inventors.

DETAILED DESCRIPTION OF THE PREFERRED EMBODIMENTS

As mentioned earlier, the present invention includes a variety of aspects, which may be combined in different ways. The following descriptions are provided to list elements and describe some of the embodiments of the present invention. These elements are listed with initial embodiments, however it should be understood that they may be combined in any manner and in any number to create additional embodiments. The variously described examples and embodiments should not be construed to limit the present invention to only the explicitly described systems, techniques, and applications. Further, this description should be understood to support and encompass descriptions and claims of all the various embodiments, systems, techniques, methods, devices, and applications with any number of the disclosed elements, with each element alone, and also with any and all various permutations and combinations of all elements in this or any subsequent application.

Figure 1:
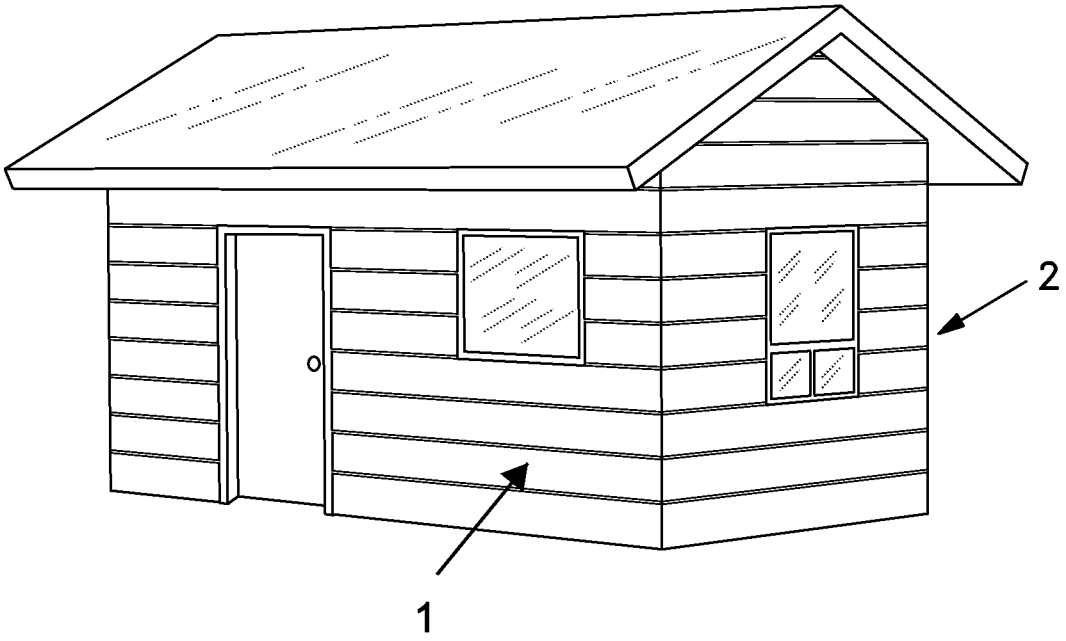
FIG. 1 is a perspective view of an embodiment of the present invention showing composite wide siding on a house.
Figure 2:
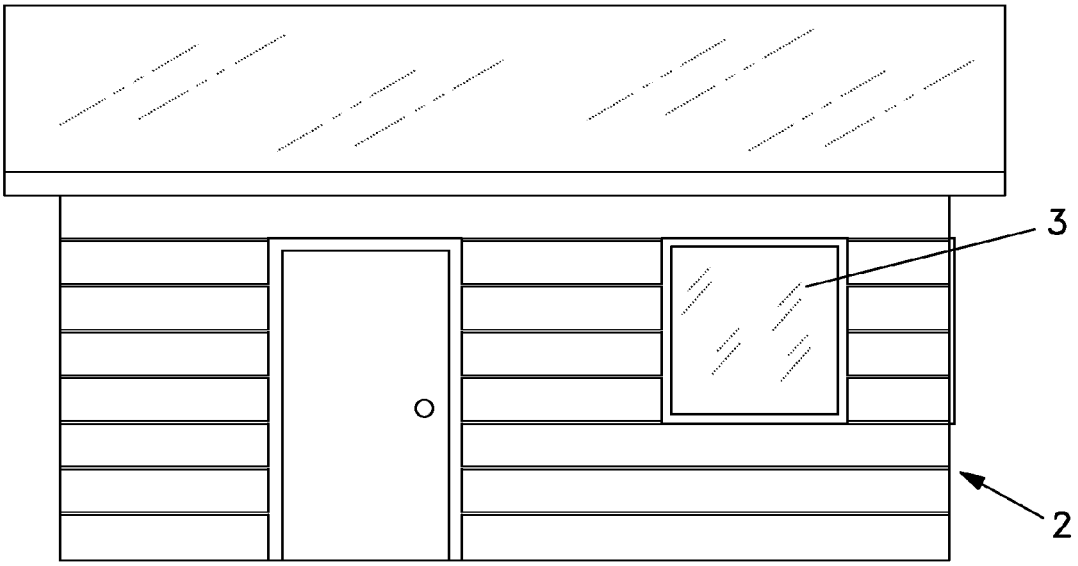
FIG. 2 is a front view of the embodiment of the present invention shown in FIG. 1.
Figure 3:
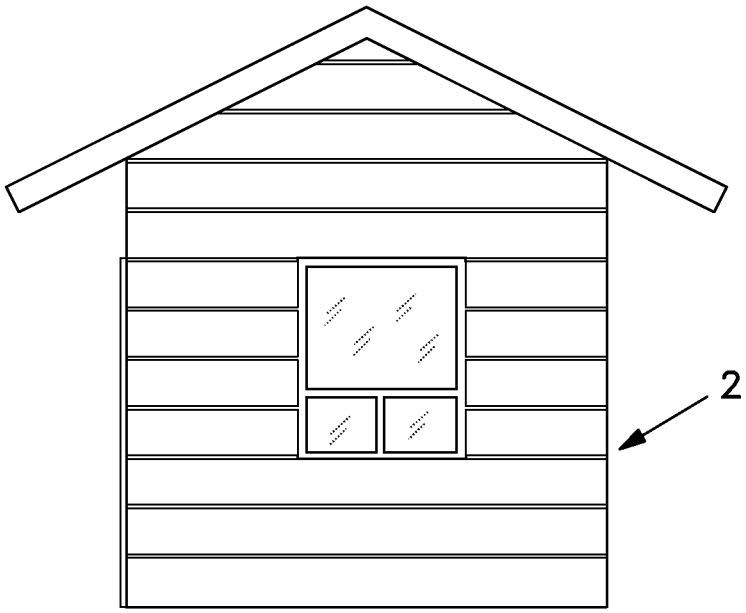
FIG. 3 is a side view of the embodiment of the present invention shown in FIG. 1.
Figure 4:
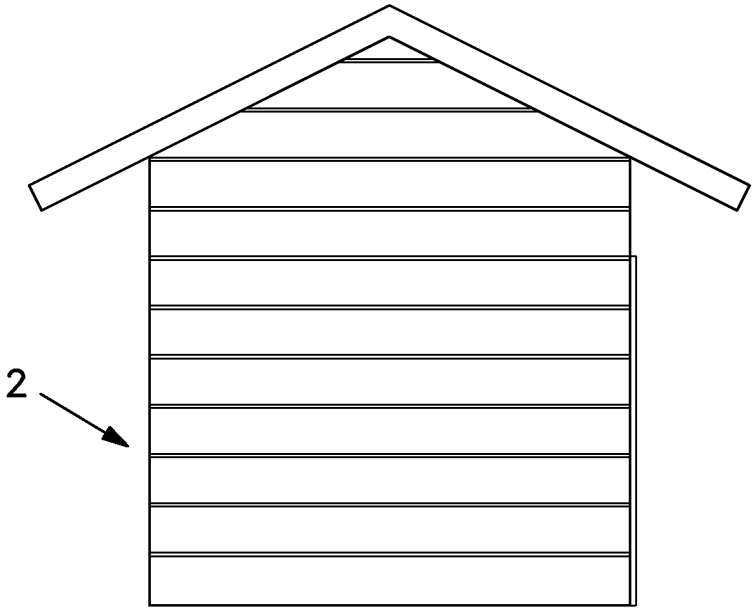
FIG. 4 is the other side view of the embodiment of the present invention shown in FIG. 1.
Figure 5:
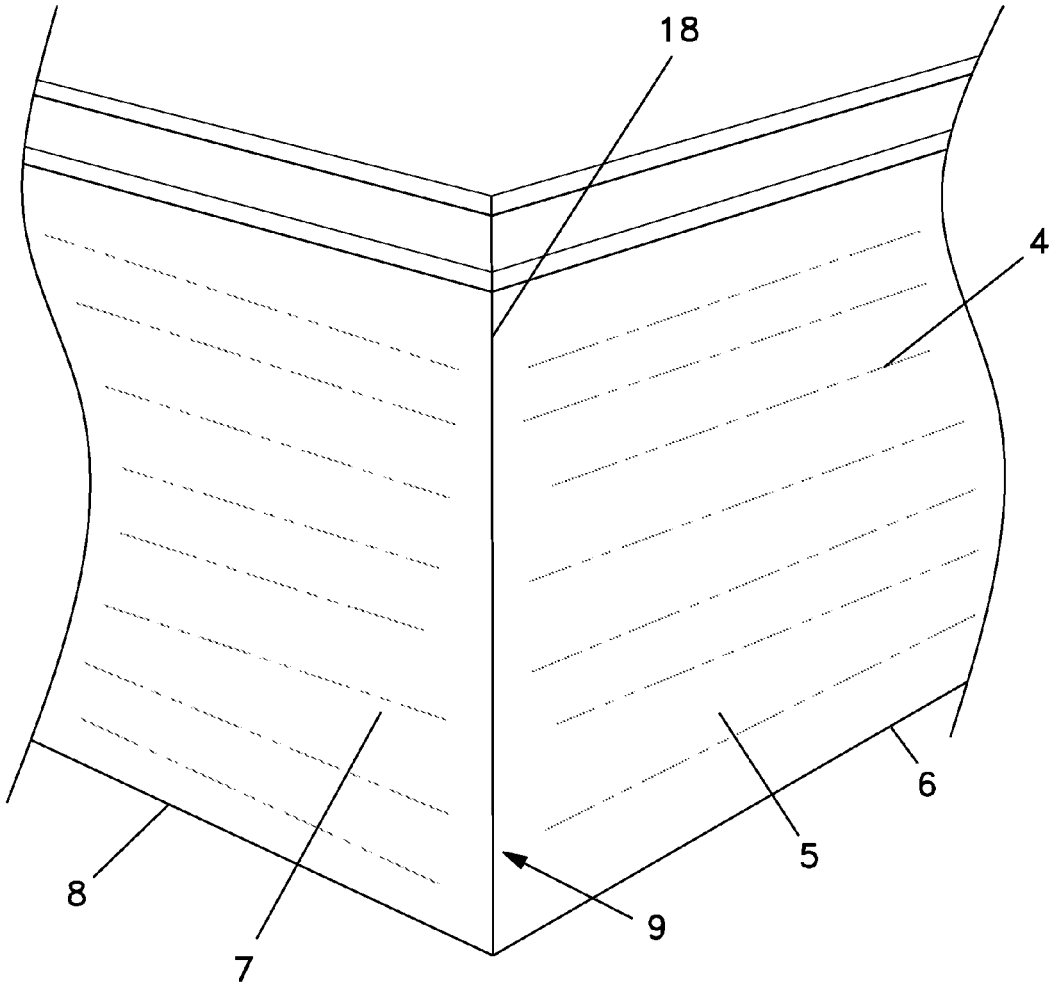
FIG. 5 is an enlarged partial view of a siding corner in accordance with some embodiments of the present invention perhaps as shown in FIG. 1.

The present invention may provide a composite wide siding panel system which may include the placement and even attachment of siding elements (1) such as but not limited to wide exterior horizontal wood panel siding over conventional or prefabricated walls or building frames or the like. Siding may be formed of horizontal or vertical panels and may be made of wood, metal, plastic, or even composite materials. Siding may be used as interior paneling for interior design of a building or structure or the like. FIGS. 1-4 show an example of siding elements perhaps even composite wide siding placed on a building such as a house (2). The wide siding paneling may provide an exterior border or even trim for a window (3) or door or the like as understood from FIGS. 1, 2, and 3. FIG. 5 shows an exploded view of a corner of a siding system showing an integral piece of siding that appears to have a seamless corner. As shown in FIG. 5, a wide siding system may appear to be a wide or even a large piece of solid material, such as wood. In embodiments, a corner or even an end piece for a wide siding system may not show the end grain of a piece of wood and may even show side grains as it may appear seamless, solid, and aesthetically beautiful.

In embodiments, the present invention may provide an aesthetically pleasing endless cornered wood siding resembling solid wood comprising a first exterior lateral surface (5) of a first integral piece (6) of a wide exterior horizontal wood panel siding horizontally integrally connected with a second exterior lateral surface (7) of a second integral piece (8) of said wide exterior horizontal wood panel siding to form a corner (9) at said connection (18) between an end of said first exterior lateral surface of said first integral piece of said wide exterior horizontal wood panel siding and an end of said second exterior lateral surface of said second integral piece of said wide exterior horizontal wood panel siding; and perhaps even a substantially uniform horizontal wood grain directional flow (4) from said first exterior lateral surface (5) of said first integral piece of said wide exterior horizontal wood panel siding around said corner (9) to said second exterior lateral surface (7) of said second integral piece of said wide exterior horizontal wood panel siding perhaps as understood in FIG. 5. As mentioned above a siding element (1) may be wide exterior horizontal wood panel siding. The connection (18) as shown in FIG. 5, may represent an example of how two ends of the two integral pieces may form a corner. In embodiments, a connection or corner may be a seemingly seamless, angled, one-piece, two-piece, one-piece for installation, smooth, flat, or the like. A connection between two integral pieces may include a corner connector joint which may be internal, may be partially internal, may be a mechanical fastener, may be an extruded aluminum fastener, or the like. A panel siding may extend any length past the corner and may even provide that at least one side of a panel siding may frame a door or window or the like. Substantially uniform wood grain direction flow (4) may provide that each side of a panel may follow a similar wood grain pattern perhaps such that it could have a same pattern if the two sides were placed into a straight panel. Of course, wood grain may have some variations due to the nature of the how wood grain may be created or obtained or the like. Wood panel siding may be composite wood panel siding, may be solid, may include several integral parts, or the like.

Embodiments of the present invention may provide an internal chamber system (15) in a siding panel element. Specifically, embodiments of the present invention may provide a siding panel element having least one chamber therein to perhaps provide a durable as well as flexible panel element. A chamber may be an enclosed hollow space. This may allow the siding panel element to expand and contract as it is exposed to weather and may prevent cracking of the panel. In embodiments, an internal chamber system may include an interior panel, an exterior panel, a top and bottom attachments that form a chamber. An internal chamber system may also provide the ability to use wide panel siding. As a non-limiting example, a siding element may have a width of greater than about 12 inches, about 15 inches, about 17.5 inches, about 24 inches, or the like. Of course, any width may be used and all are meant to be included in this disclosure. The width may or may not include any tongue and groove components as discussed below.

Figure 6:
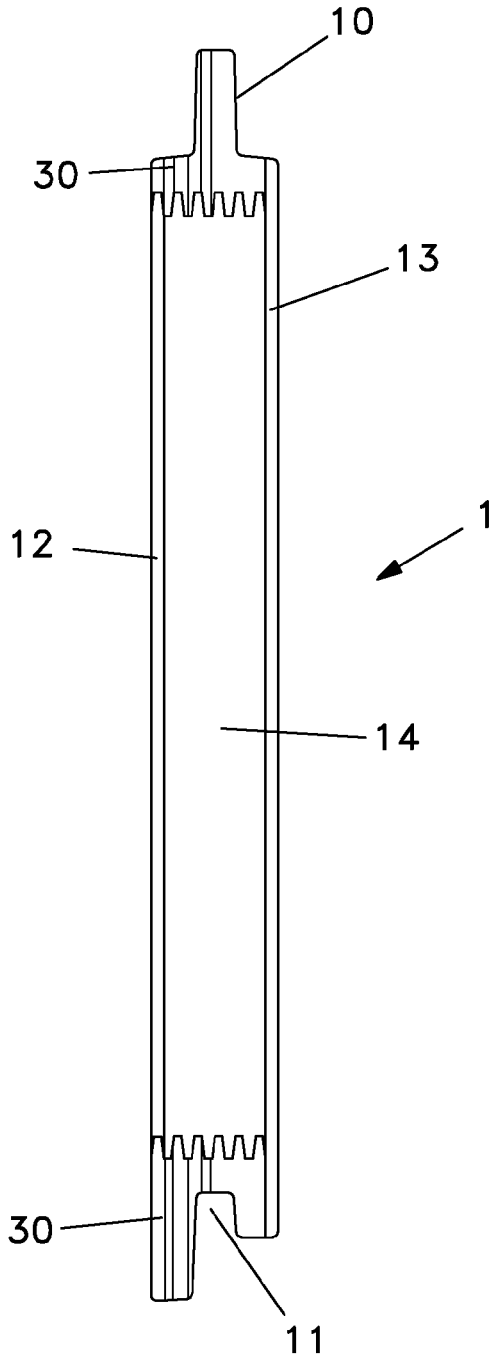
FIG. 6 is a cross sectional view of a siding element in accordance with some embodiments of the present invention.
Figure 8:
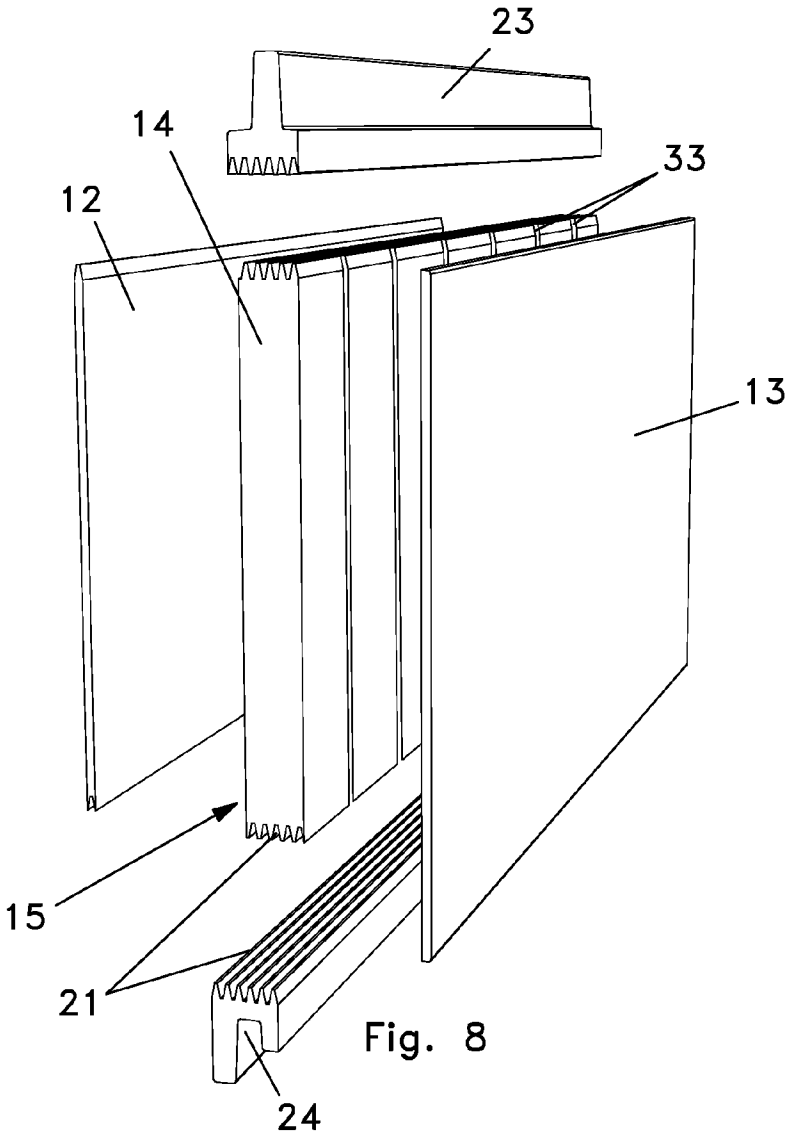
FIG. 8 is an exploded perspective view of the siding element as shown in FIG. 7.
Figure 7:
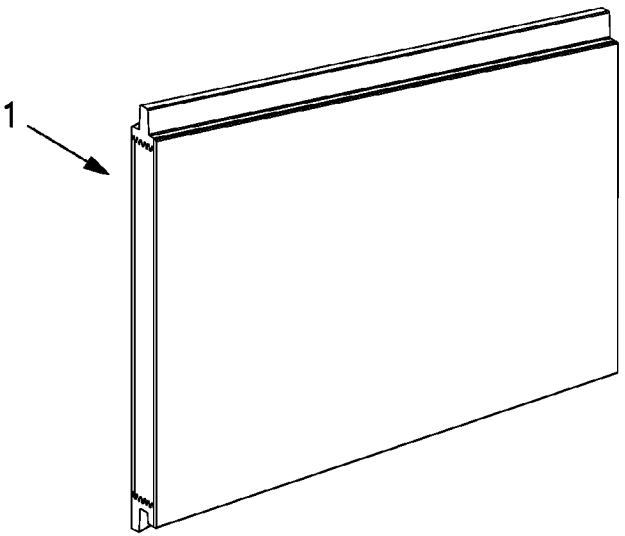
FIG. 7 is a perspective partial view of a siding element in accordance with some embodiments of the present invention.

As can be understood in the examples of FIGS. 6, 7, and 8, embodiments of the present invention may provide a siding element (1) which may have an internal chamber system (15) inside the panel element. For example, at least one interior core element (14) may be placed inside a panel. An interior core element may be a support which may even fit within the panel element. An interior core element may be shaped as a thin structure, a thick structure, a block, about a 2" by 2" shape, a rectangular shape, a square shape, a circular shape, or the like and may even be made of wood, veneer, plastic, plywood, metal, installation, or the like materials. An interior core element (14) may be spaced within a panel element or may be a plurality of interior core elements placed within a panel element perhaps providing a space (33) between each or even some of the interior core elements. As a non-limiting example, the interior core elements may be spaced about ⅛" apart. Of course, an amount of spacing may vary and all distances are meant to be included in this disclosure. Finger joints (21) may enclose the top and bottom of the siding panel element and may attach to the internally spaced interior core elements. An attachment between the interior core elements and the finger joints may be with glue or the like. Outside pieces of a panel element may be thin sheets of veneer, wood veneer, metal veneer, stucco, or the like materials and may be located at the exterior of the siding panel element. In embodiments, outside pieces of a panel element may include an interior element which may be placed against a building wall and may also include an exterior element that can be exposed to the environment and may provide the aesthetically beautiful appearance of the paneling. Therefore, the internal piece may be different from the external piece perhaps in the type of materials used or the like. In embodiments, this may apply to a tongue or groove as discussed herein.

FIG. 6 shows an example of a cross sectional view of a siding element (1). An internal panel piece (12) such as a Western Red Cedar Veneer or the like may be located at the inside of the panel element. An exterior panel piece (13) such as a wood or even a metal veneer or stucco or the like may be located at the outside of the panel element. An interior core element (14) may be a wood core element or the like which may extend an internal cavity, may fit in an internal cavity, may fit vertically in an internal cavity, may fit in part in an internal cavity, or the like of a siding element and may even be about 2"×2" in shape or the like. Plywood backing (30) or any kind of material or backing or the like may be provided at the end of each panel element. A connection element such as but not limited to finger joints (21) may be placed at the top, bottom, or even both of a panel element. A top and bottom of a panel element may provide an interlocking mechanism to attach the panels together to form a composite siding. In embodiments, a connection element may provide a finger joint connection with the interior core element and may even provide an interlocking element between the siding elements. For example, a tongue attachment element (23) and perhaps even a groove attachment element (24) may be connected to an interior core element (14) perhaps as understood from FIGS. 7 and 8. In embodiments, a tongue attachment element (23) and perhaps even a groove attachment element (24) may be made partly of a plywood backing or other material perhaps half or more or less or the like. The other part of the attachment elements may be made of the exterior materials such as wood or metal veneers or the like.

Figure 10:
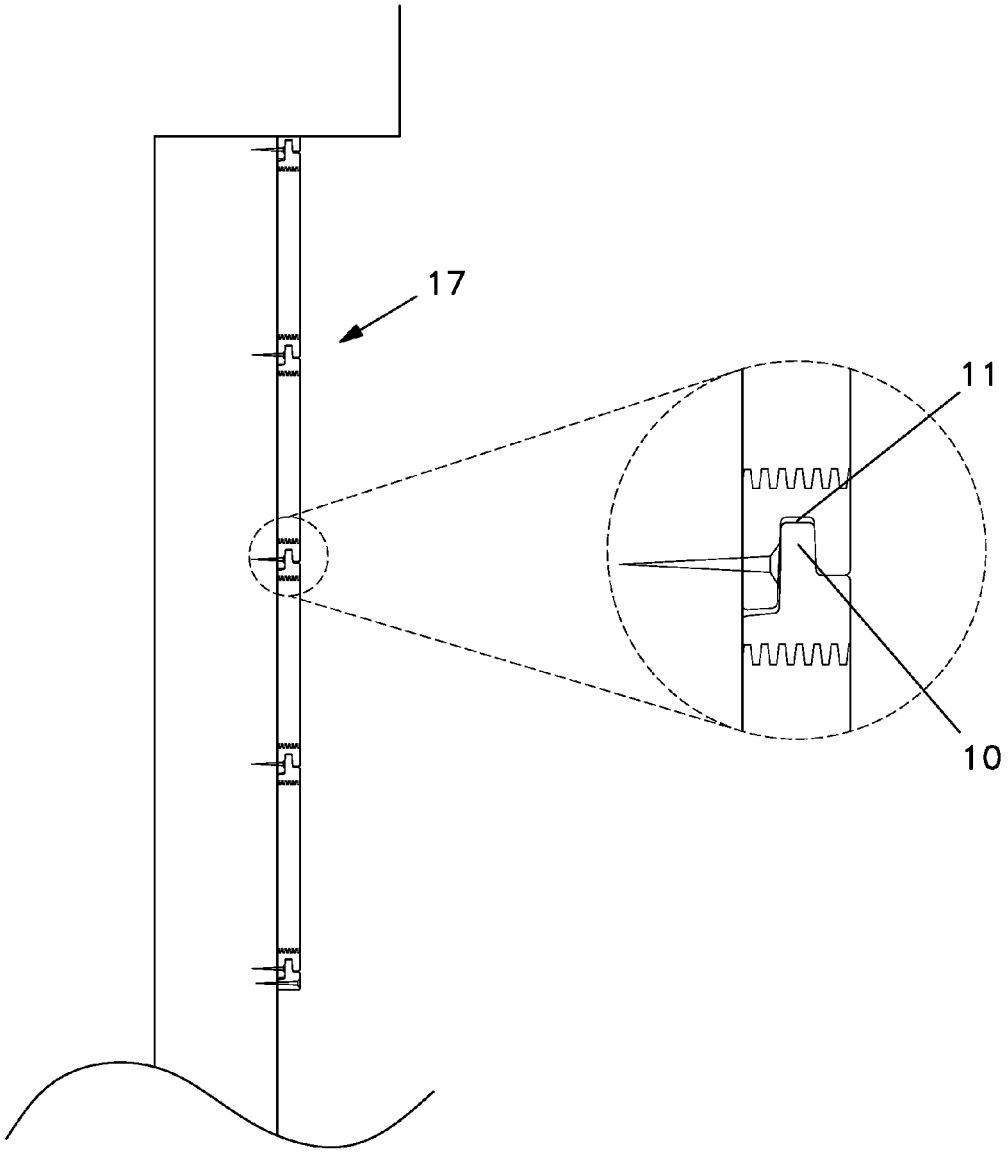
FIG. 10 is a profile view of tightly stacked siding elements providing a planar composite siding on a wall in accordance with some embodiments of the present invention.

The interlocking ends may be a tongue and groove type attachment such that one end of a siding element may fit into another end of siding element. As attached, the siding elements may be placed edge to edge together to allow two flat pieces of siding to make a flat surface. Each piece may have a slot or groove (11) cut along one edge and a thin, deep ridge, or the tongue (10), on the opposite edge as may be understood from FIGS. 6, 7, 8, 11, and 12. In embodiments, the tongue may project a little less than the groove is deep. As shown in FIG. 10, when the tongue may be shorter than the groove and perhaps even when panel elements are placed together, a composite siding may be flat, may be planar, and may even have a substantially smooth surface perhaps providing stacked connected siding elements (17) or even tightly stacked connected siding element.

Figure 9:
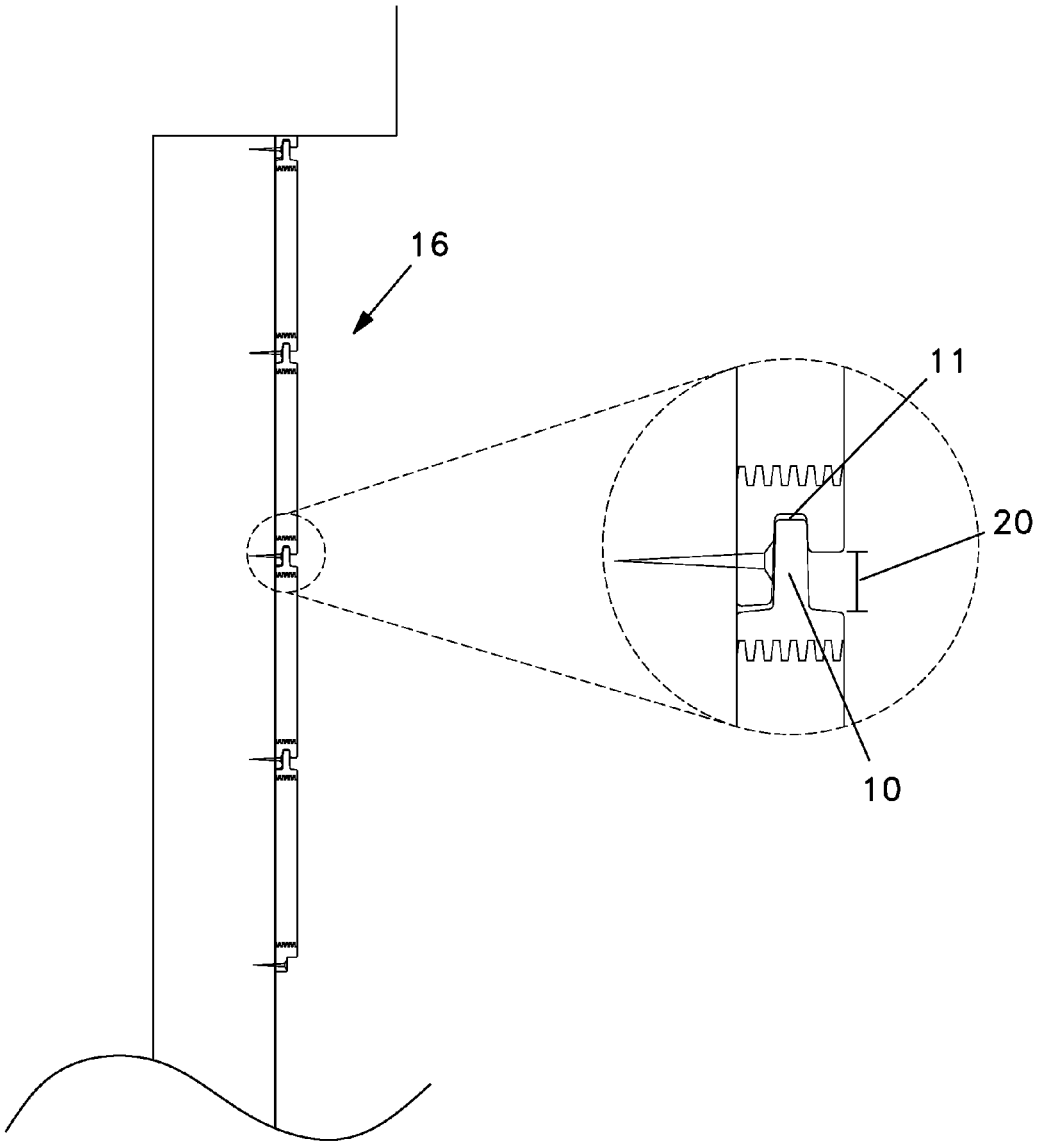
FIG. 9 is a profile view of stacked siding elements providing gapped composite siding on a wall in accordance with some embodiments of the present invention.

In other embodiments, when the panels are interlocked together, the edges of a siding element may be spaced apart by a gap (20) perhaps providing gapped connected siding elements (16). A tongue (10) may project longer than a groove (11) is deep perhaps to provide a gap between the connected siding elements as shown in FIG. 9. As a non-limiting example, a gap between two panel elements may include about 1 inch, about 1.5 inches, about 2 inches, or the like. A gap between the siding panels may provide a C-shaped or even squared groove-type gap between the panels.

Figure 11:
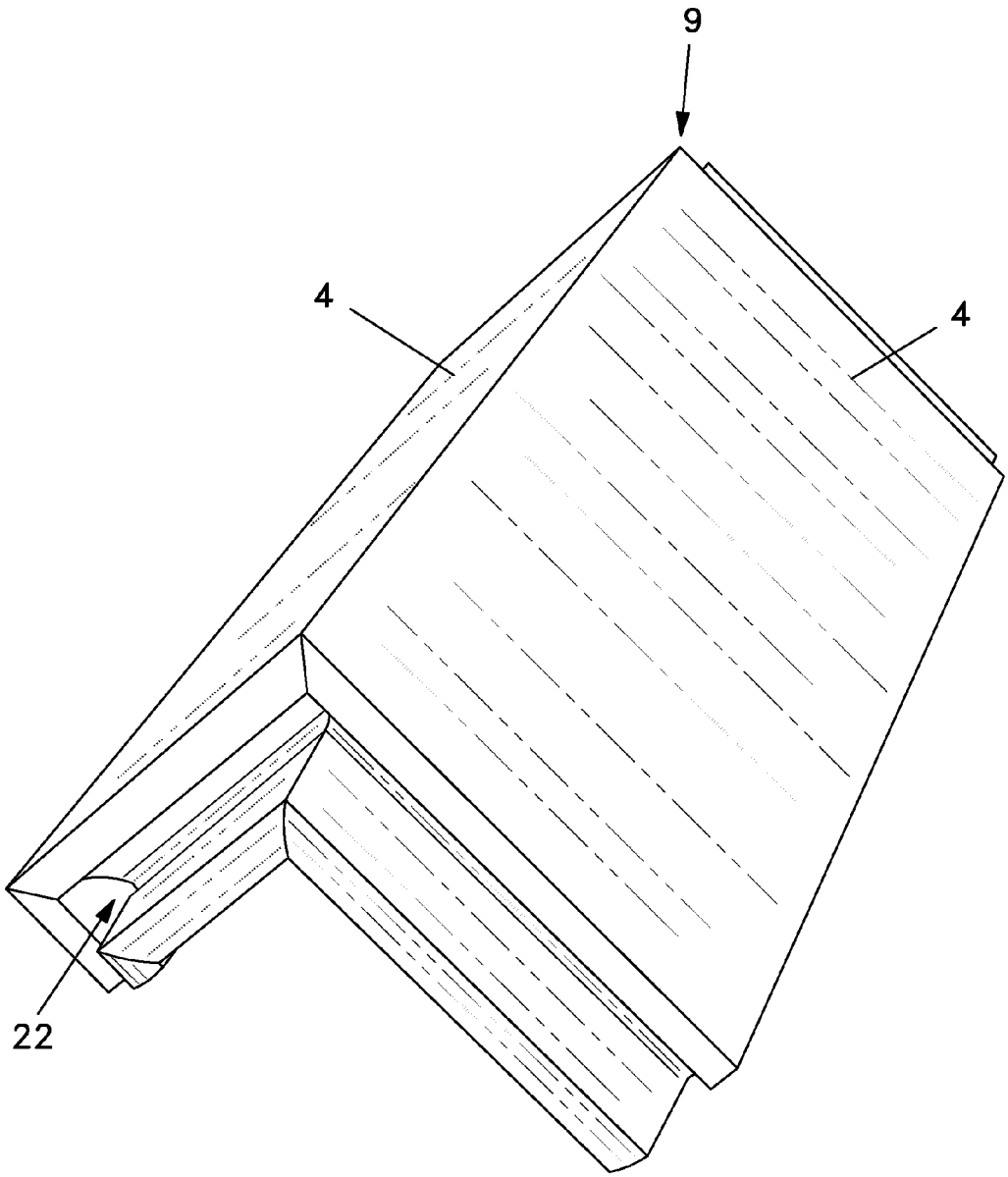
FIG. 11 is a perspective partial view of a corner of a wood siding element showing a corner groove in accordance with some embodiments of the present invention.
Figure 12:
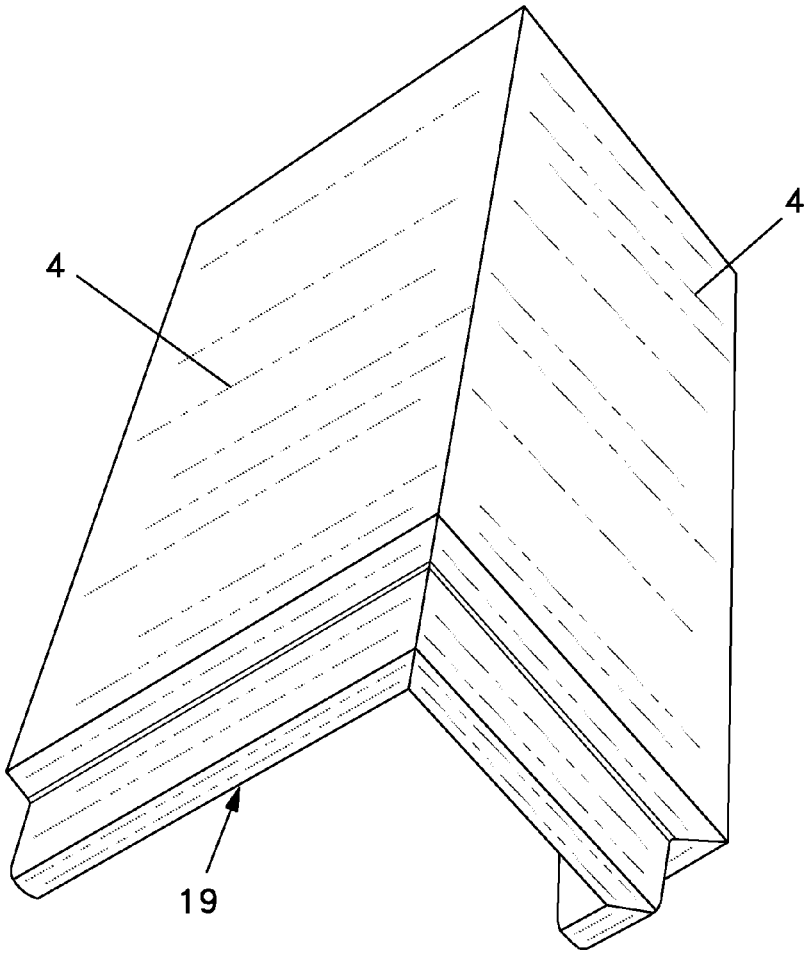
FIG. 12 is a perspective partial view of a corner of a wood siding element showing a corner tongue in accordance with some embodiments of the present invention.

An end piece or corner of a panel siding system may be understood from FIGS. 11 and 12. The corners or end pieces may be constructed of panel elements which may even have an internal chamber system as discussed herein. For example, cornered panels may have a corner tongue (19) and may even have a corner groove (22) so that the corners can stack together perhaps in a similar way as discussed herein. When assembled into a composite panel system, this may provide the appearance that the siding is made of solid wood pieces when it may really only be made of composite materials. Alternatively, a panel siding element and any end pieces or corners thereof may be made of metal which may also provide the appearance of solid metal pieces in alternative embodiments. Corners of a panel siding may be at a horizontal position such as shown in FIGS. 1 through 5. As discussed herein, a corner of a panel may not be a corner end cap, it may be a seemingly continuous piece around a corner. Alternatively, panels may be placed in a vertical position having vertical wood grain flow or the like.

As can be easily understood from the foregoing, the basic concepts of the present invention may be embodied in a variety of ways. It involves both wide siding techniques as well as devices to accomplish the appropriate wide siding. In this application, the wide siding techniques are disclosed as part of the results shown to be achieved by the various devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

The discussion included in this application is intended to serve as a basic description. The reader should be aware that the specific discussion may not explicitly describe all embodiments possible; many alternatives are implicit. It also may not fully explain the generic nature of the invention and may not explicitly show how each feature or element can actually be representative of a broader function or of a great variety of alternative or equivalent elements. Again, these are implicitly included in this disclosure. Where the invention is described in device-oriented terminology, each element of the device implicitly performs a function. Apparatus claims may not only be included for the device described, but also method or process claims may be included to address the functions the invention and each element performs. Neither the description nor the terminology is intended to limit the scope of the claims that will be included in any subsequent patent application.

It should also be understood that a variety of changes may be made without departing from the essence of the invention. Such changes are also implicitly included in the description. They still fall within the scope of this invention. A broad disclosure encompassing both the explicit embodiment(s) shown, the great variety of implicit alternative embodiments, and the broad methods or processes and the like are encompassed by this disclosure and may be relied upon when drafting the claims for any subsequent patent application. It should be understood that such language changes and broader or more detailed claiming may be accomplished at a later date (such as by any required deadline) or in the event the applicant subsequently seeks a patent filing based on this filing. With this understanding, the reader should be aware that this disclosure is to be understood to support any subsequently filed patent application that may seek examination of as broad a base of claims as deemed within the applicant's right and may be designed to yield a patent covering numerous aspects of the invention both independently and as an overall system.

Further, each of the various elements of the invention and claims may also be achieved in a variety of manners. Additionally, when used or implied, an element is to be understood as encompassing individual as well as plural structures that may or may not be physically connected. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of a "joint" should be understood to encompass disclosure of the act of "joining"—whether explicitly discussed or not—and, conversely, were there effectively disclosure of the act of "joining", such a disclosure should be understood to encompass disclosure of a "joint" and even a "means for joining." Such changes and alternative terms are to be understood to be explicitly included in the description. Further, each such means (whether explicitly so described or not) should be understood as encompassing all elements that can perform the given function, and all descriptions of elements that perform a described function should be understood as a non-limiting example of means for performing that function.

Any patents, publications, or other references mentioned in this application for patent are hereby incorporated by reference. Any priority case(s) claimed by this application is hereby appended and hereby incorporated by reference. In addition, as to each term used it should be understood that unless its utilization in this application is inconsistent with a broadly supporting interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information disclosure statement or other information statement filed with the application are hereby appended and hereby incorporated by reference, however, as to each of the above, to the extent that such information or statements incorporated by reference might be considered inconsistent with the patenting of this/these invention(s) such statements are expressly not to be considered as made by the applicant(s).

Thus, the applicant(s) should be understood to have support to claim and make a statement of invention to at least: i) each of the siding devices as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) each system, method, and element shown or described as now applied to any specific field or devices mentioned, x) methods and apparatuses substantially as described hereinbefore and with reference to any of the accompanying examples, xi) an apparatus for performing the methods described herein comprising means for performing the steps, xii) the various combinations and permutations of each of the elements disclosed, xiii) each potentially dependent claim or concept as a dependency on each and every one of the independent claims or concepts presented, and xiv) all inventions described herein.

With regard to claims whether now or later presented for examination, it should be understood that for practical reasons and so as to avoid great expansion of the examination burden, the applicant may at any time present only initial claims or perhaps only initial claims with only initial dependencies. The office and any third persons interested in potential scope of this or subsequent applications should understand that broader claims may be presented at a later date in this case, in a case claiming the benefit of this case, or in any continuation in spite of any preliminary amendments, other amendments, claim language, or arguments presented, thus throughout the pendency of any case there is no intention to disclaim or surrender any potential subject matter. It should be understood that if or when broader claims are presented, such may require that any relevant prior art that may have been considered at any prior time may need to be re-visited since it is possible that to the extent any amendments, claim language, or arguments presented in this or any subsequent application are considered as made to avoid such prior art, such reasons may be eliminated by later presented claims or the like. Both the examiner and any person otherwise interested in existing or later potential coverage, or considering if there has at any time been any possibility of an indication of disclaimer or surrender of potential coverage, should be aware that no such surrender or disclaimer is ever intended or ever exists in this or any subsequent application. Limitations such as arose in *Hakim v. Cannon Avent Group, PLC,* 479 F.3d 1313 (Fed. Cir 2007), or the like are expressly not intended in this or any subsequent related matter. In addition, support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. In drafting any claims at any time whether in this application or in any subsequent application, it should also be understood that the applicant has intended to capture as full and broad a scope of coverage as legally available. To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible. The use of the phrase, "or any other claim" is used to provide support for any claim to be dependent on any other claim, such as another dependent claim, another independent claim, a previously listed claim, a subsequently listed claim, and the like. As one clarifying example, if a claim were dependent "on claim 20 or any other claim" or the like, it could be re-drafted as dependent on claim 1, claim 15, or even claim 25 (if such were to exist) if desired and still fall with the disclosure. It should be understood that this phrase also provides support for any combination of elements in the claims and even incorporates any desired proper antecedent basis for certain claim combinations such as with combinations of method, apparatus, process, and the like claims.

Finally, any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

What is claimed is:

1. An aesthetically pleasing endless cornered wood siding resembling solid wood comprising:

a first substantially smooth exterior lateral surface of a first integral piece of a wide exterior horizontal wood panel siding horizontally integrally connected with a second substantially smooth exterior lateral surface of a second integral piece of said wide exterior horizontal wood panel siding to form a corner at said connection between an end of said first exterior lateral surface of said first integral piece of said wide exterior horizontal wood panel siding and an end of said second exterior lateral surface of said second integral piece of said wide exterior horizontal wood panel siding;

a substantially uniform horizontal wood grain directional flow from substantially all of said first substantially smooth exterior lateral surface of said first integral piece of said wide exterior horizontal wood panel siding around said corner to said substantially all of second substantially smooth exterior lateral surface of said second integral piece of said wide exterior horizontal wood panel siding; and an internal chamber system in each of said integral pieces of said wide exterior horizontal wood panel siding;

wherein said first substantially smooth exterior lateral surface of said first integral piece of said wide exterior horizontal wood panel siding connected with said second substantially smooth exterior lateral surface of said second integral piece of said wide exterior horizontal wood panel siding forms a seemingly endless substantially smooth continuous wood panel siding.

2. An aesthetically pleasing endless cornered wood siding resembling solid wood according to claim 1 wherein said internal chamber system further comprises at least one interior core element located in said internal chamber system in each of said integral pieces of said wide exterior horizontal wood panel siding.

3. An aesthetically pleasing endless cornered wood siding resembling solid wood according to claim 2 wherein said at least one interior core element located in said internal chamber system in each of said integral pieces of said wide exterior horizontal wood panel siding comprises a plurality of spaced interior core elements located in said internal chamber system in said wide exterior horizontal wood panel siding.

4. An aesthetically pleasing endless cornered wood siding resembling solid wood according to claim 1 wherein said corner at said connection comprises a smooth corner at said connection.

5. An aesthetically pleasing endless cornered wood siding resembling solid wood according to claim 3 wherein said plurality of spaced interior core elements located in said internal chamber system in said wide exterior horizontal wood panel siding are spaced within said internal chamber system.

6. An aesthetically pleasing endless cornered wood siding resembling solid wood according to claim 1 wherein said substantially uniform horizontal wood grain directional flow comprise a substantially uniform horizontal wood side grain directional flow.

* * * * *